US007303189B2

(12) United States Patent
Huang et al.

(10) Patent No.: US 7,303,189 B2
(45) Date of Patent: Dec. 4, 2007

(54) SYSTEM FOR MEDIA HANDLING

(75) Inventors: Xiaoxi Huang, Singapore (SG); Choon-Siang Peck, Singapore (SG); Wee-Lian Tan, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 322 days.

(21) Appl. No.: 11/207,345

(22) Filed: Aug. 19, 2005

(65) Prior Publication Data

US 2007/0040320 A1 Feb. 22, 2007

(51) Int. Cl.
*B65H 3/06* (2006.01)

(52) U.S. Cl. ..... 271/118; 271/189; 271/220

(58) Field of Classification Search ..... 271/4.01, 271/4.08, 4.1, 117, 118, 189, 207, 220
See application file for complete search history.

(56) References Cited

U.S. PATENT DOCUMENTS 5,883,655 A * 3/1999 Szlucha ..... 347/104
6,148,727 A 11/2000 Parthasarathy
6,390,703 B1 5/2002 Kinas
6,634,745 B2 10/2003 Tanno
6,722,802 B2 4/2004 Teo
6,796,556 B2 9/2004 Robertson
7,080,948 B2 * 7/2006 Kang ..... 400/625
2004/0100545 A1 * 5/2004 Kang ..... 347/104

* cited by examiner

*Primary Examiner*—Patrick Mackey
*Assistant Examiner*—Michael C McCullough

(57) ABSTRACT

A media handling system is disclosed, which system includes a media picking unit for picking up individual media sheets from a stack of media sheets and a media output unit for advancing a printed media sheet toward an output area. The media picking unit includes a rotatable lifting shaft, a rotatable pick roller shaft, a pick roller and a pick arm. The pick roller is rotatably connected to one end of a pick arm, and the one end of the pick arm is pivotally connected to the pick roller shaft. The media output unit includes at least one sheet support member operable to support the printed portion of the media sheet above the output area. The sheet support member is linked to the lifting shaft by a linking structure such that the sheet support member is movable between a supporting position and a retracted position by a rotational movement the lifting shaft.

13 Claims, 3 Drawing Sheets

SYSTEM FOR MEDIA HANDLING

FIELD OF INVENTION

The present invention relates generally to media handling systems for image forming apparatuses, such as printers.

BACKGROUND

In certain types of image forming apparatus, such as printers, media sheets are directed through a print cycle, which includes picking up a media sheet from an input tray, feeding the sheet through the print zone, and ejecting it onto an output tray. It is generally desirable to support the ejected media sheet momentarily to allow the sheet to dry before it falls onto the output tray where previously ejected sheets form an output stack. This momentary delay is especially useful in inkjet printers, which eject wet ink to form images. A variety of sheet supporting systems have been used to accomplish this momentary delay in stacking media sheets.

One such system embodies a passive drop scheme, wherein the printed sheet is temporarily suspended by guide rails or wings above the output tray before the sheet falls onto the output tray on its own weight. Another known system involves the use of an active drop mechanism, wherein the printed sheet is guided along a pair of movable wings that temporarily support the printed sheet above the output tray. When printing is completed, the wings retract, allowing the sheet to fall into the output tray. These conventional sheet supporting systems require a separate actuator or separate control mechanisms, which add bulkiness to the printers, and also require relatively complicated synchronization between movements of the sheet supporting parts and other parts of the sheet output system. As a consequence, the production cost of the printers would have to be increased if these sheet supporting systems are to be implemented.

There exists a need for a media output system with a sheet supporting mechanism that does not require a complicated control system to operate and can be implemented at a relatively low cost.

SUMMARY

The present invention provides a media handling system that includes a media picking unit for picking up individual media sheets from a stack of media sheets and a media output unit for advancing a printed media sheet toward an output area. The media picking unit includes a rotatable lifting shaft, a rotatable pick roller shaft, a pick roller and a pick arm. The pick roller is rotatably connected to one end of the pick arm, and the one end of the pick arm is pivotally connected to the pick roller shaft. The media output unit includes at least one sheet support member operable to support the printed portion of the media sheet above the output area. The sheet support member is linked to the lifting shaft by a linking structure such that the sheet support member is movable between a supporting position and a retracted position by a rotational movement the lifting shaft.

The objects and advantages of the present invention will become apparent from the detailed description when read in conjunction with the drawings.

DETAILED DESCRIPTION

Figure 1:
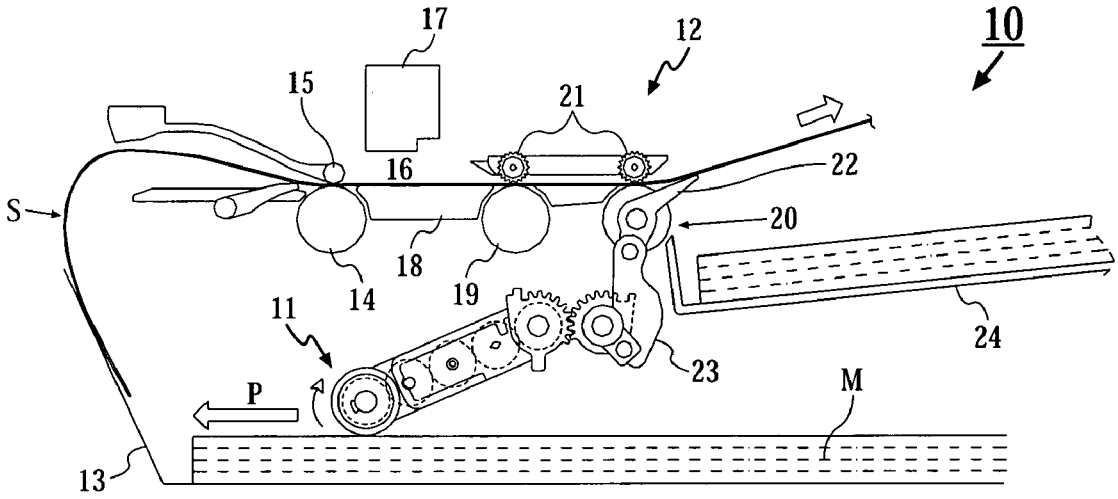
FIG. 1 is a sectional view of an inkjet printer in accordance with one embodiment of the present invention, showing a media picking unit, an output roller assembly and a pair of sheet support wings.

FIG. 1 schematically shows an inkjet printer 10 embodying an embodiment. The concept is not limited, however, to inkjet printers. The concept may be implemented in any printing apparatus that forms images on sheet media using ink. Examples of other printing apparatuses include copiers, plotters, and facsimile machines. Referring to FIG. 1, the inkjet printer 10 includes a media picking unit 11 and a media output unit 12. The media picking unit 11 is operable for picking up an individual media sheet from a stack of media sheets M and directing the sheet to a media path (depicted by arrow P). The stack of media sheets M is placed in an input tray 13. A linefeed roller 14 and a cooperating pinch roller 15 are arranged along the media path and downstream from the media picking unit 11 to convey the media sheet S to a print zone 16. At least one ink cartridge 17 is provided to eject ink onto the media sheet during printing and a platen 18 is positioned below the ink cartridge for supporting the media sheet during printing.

The media output unit 12 includes a primary output roller 19, a secondary roller assembly 20, starwheels 21 and a pair of sheet support wings 22 (only one is shown in this view). The support wings 22 are linked to the media picking unit 11 by a linking structure 23. The primary output roller 19 and the secondary roller assembly 20 cooperate with their respective starwheels 21 to advance the printed media sheet from the print zone 16 toward an output tray 24. The support wings 22, in the extended position as shown, support the printed portion of the media sheet above the output tray 24 as the media sheet is advancing from the print zone 16 toward the output tray 24.

Figure 2:
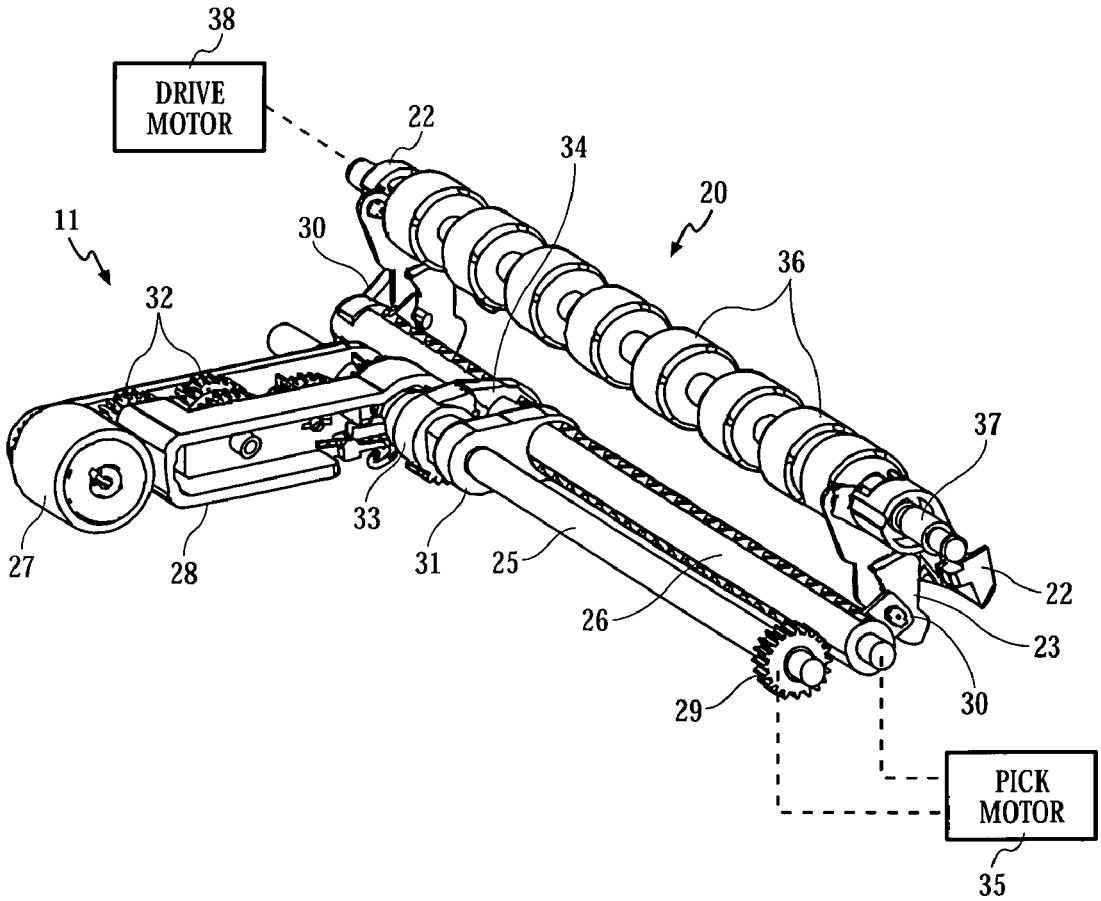
FIG. 2 is a perspective view showing how the sheet support wings are linked to the picking unit according to an embodiment of the present invention.

FIG. 2 is a perspective view showing the structural components of the media picking unit 11 and the output roller assembly 20. The media picking unit 11 includes a rotatable pick roller shaft 25, a rotatable lifting shaft 26, a pick roller 27, and a pick arm 28. The pick roller 27 is rotatably connected to one end of the pick arm 28 while the other end of the pick arm is pivotally connected to the pick roller shaft 25. The pick roller shaft 25 has a drive gear 29 at one end. The lifting shaft 26 has a pair of crank members 30 fixedly mounted to opposite ends of the lifting shaft. The pick roller shaft 25 is further coupled to the lifting shaft 26 by a coupling structure 31. This coupling arrangement provides reinforcement to the two shafts. The pick arm 28 has a gear train 32 mounted thereon to transmit a driving force from the pick roller shaft 25 to the pick roller 27. A passive lifting gear 33 is rotatably mounted on the pick roller shaft 25 at a location adjacent to the pick arm 28. An active lifting gear 34 is fixedly mounted on the lifting shaft 26 and in driving engagement with the passive lifting gear 33. A pick motor 35 is provided to transmit a driving force to the pick roller shaft 25 via the drive gear 29. The same pick motor 35 also transmits a driving force to the lifting shaft 26.

The secondary output roller assembly 20 includes a plurality of output rollers 36 mounted on an output roller shaft 37. A drive motor 38 is provided to transmit a driving force to the output roller shaft 37. The sheet support wings 22 are rotatably mounted to the output roller shaft 37 at opposite ends of the output roller shaft. Each sheet support wing 22 is pivotally linked to one end of the corresponding linking structure 23. The other end of the linking structure 23 is pivotally linked to the corresponding crank member 30. Although only two sheet support wings are shown, it should be understood that more than two sheet support wings may be mounted along the output roller shaft 37.

Figure 3A:
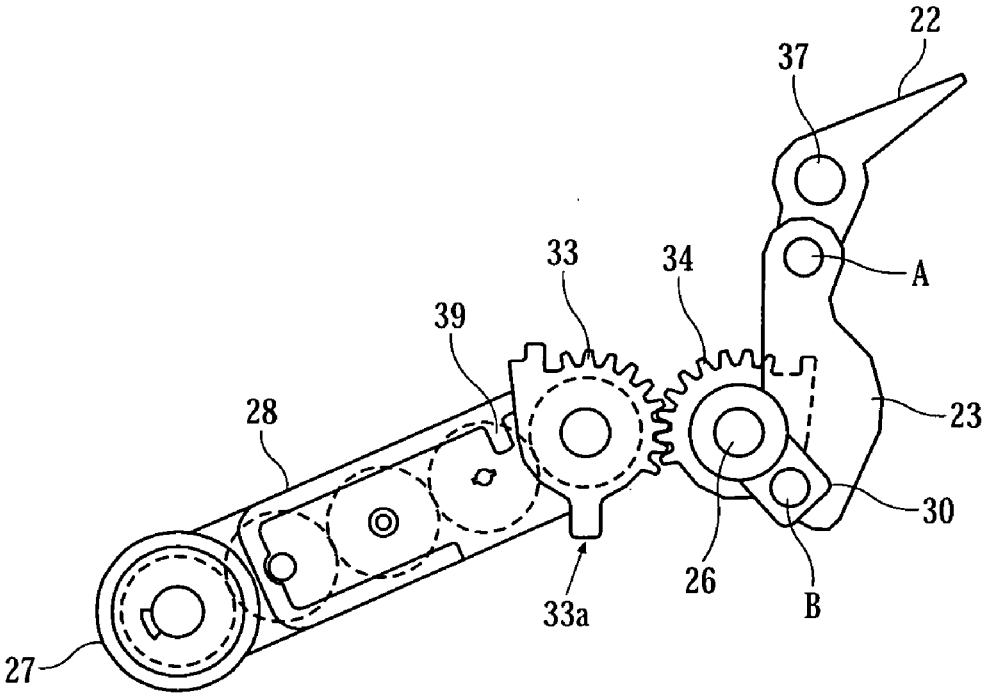
FIGS. 3A and 3B are close-up views illustrating the mechanics of the linking structure that links the sheet support wings to the media picking unit according to an embodiment of the present invention.
Figure 3B:
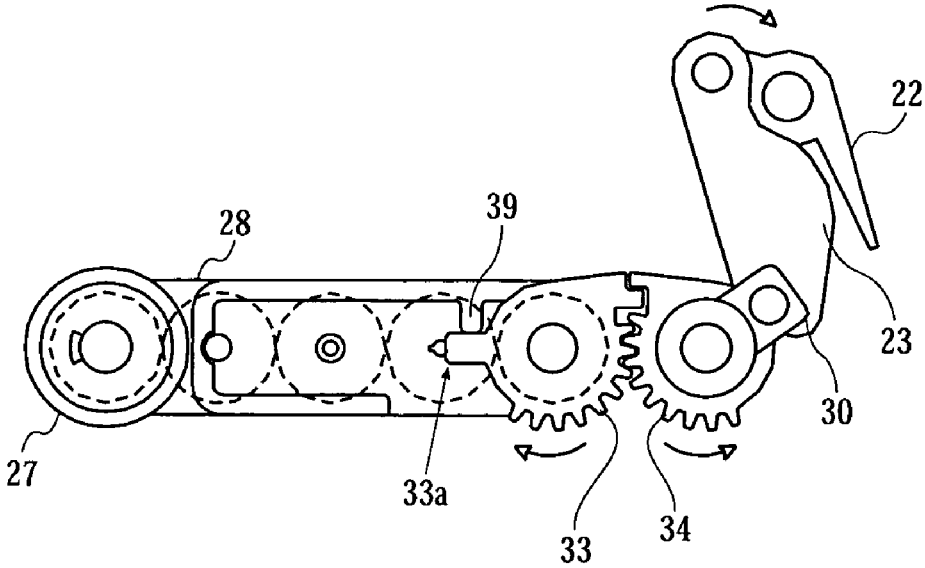

The mechanics of the linking structure 23 will now be described with reference to FIGS. 3A and 3B. FIG. 3A shows the pick arm 28 in a picking position and the sheet support wings 22 in a supporting position, i.e. extended position. The passive lifting gear 33 has a finger-like radial feature 33*a*. The pick arm 28 is further provided with a stopper 39 adjacent to the passive lifting gear 33. Each linking structure 23 has two pivot joints A and B: each wing 22 is pivotally linked to the corresponding linking structure at pivot joint A and the linking structure is pivotally linked to the corresponding crank member 30 at pivot joint B. Each wing 22 is rotatable about the roller shaft 37 by the movement of the corresponding linking structure 23. To go from the position of FIG. 3A to FIG. 3B, the lifting shaft 26 is driven to rotate counterclockwise (by the pick motor), the active lifting gear 34 also rotates counterclockwise, thereby causing the passive lifting gear 33 to rotate clockwise until the radial feature 33*a* abuts against the stopper 38. The lifting force from radial member 33*a* causes the pick arm 28 to pivot upward and the pick roller 27 is lifted up. In addition, each crank member 30 also rotates counterclockwise in conjunction with the rotational movement of the lifting shaft 26. The counterclockwise movement of each crank member 30 causes the corresponding linking structure 23 to shift upward and to pivot slightly counterclockwise, thereby causing the support wing 22 to rotate clockwise into a retracted position shown in FIG. 3B. As can be seen from FIG. 3B, the pick roller 27 and the pick arm 28 are in an inactivated position when the support wings 22 are retracted. From the retracted position (FIG. 3B), the support wings 22 can be affected to pivot to the extended position (FIG. 3A) by rotating the cranks 30 clockwise.

Figure 4:
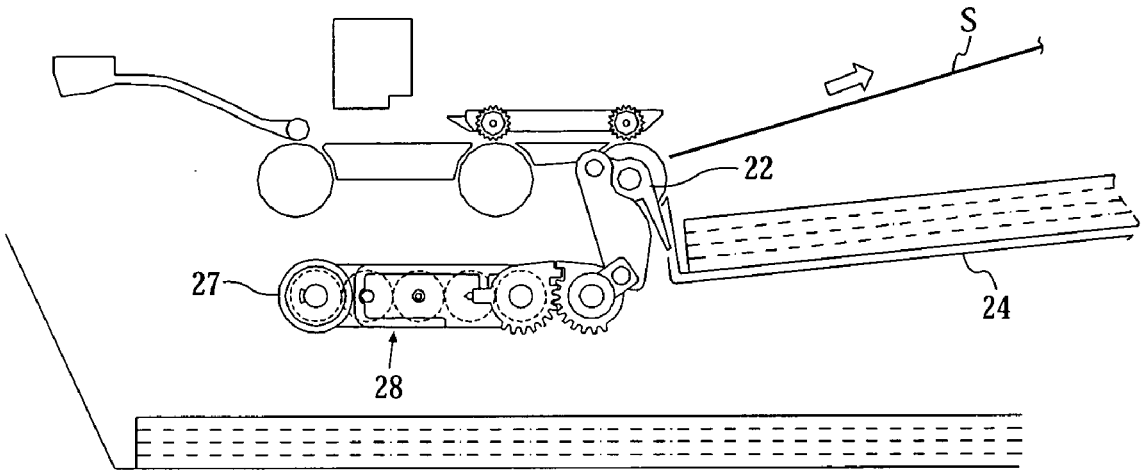
FIG. 4 is a sectional view of the printer showing the sheet support wings in a retracted position and the media picking unit in a de-activated position according to an embodiment of the present invention.

FIG. 4 shows the printer 10 with the sheet support wings 22 in the retracted position, the pick roller 27 and the pick arm 28 in the inactivated position, and a printed media sheet S being ejected onto the output tray 24. The retraction of the sheet support wings 22 is activated based on the type of media being used. For printing on plain media, the support wings 22 may be maintained in the supporting (or extended) position during the entire printing cycle in order to prevent throughput loss from moving the pick arm up and down each time a media sheet is printed. With certain ejecting speed, it is possible to eject the plain media sheet onto the output tray without retracting the support wings. On the other hand, gradual retraction of the support wings 22 would be advantageous during photographic printing because it is undesirable to eject printed photographic media at high speed. During photographic printing, the support wings start to retract when a full page print job is completed and a predetermined drying time has elapsed. In general, the control of the wings' position is related to the properties of the media and the ink, and such control can be provided by printing device software and firmware systems.

Figure 5A:
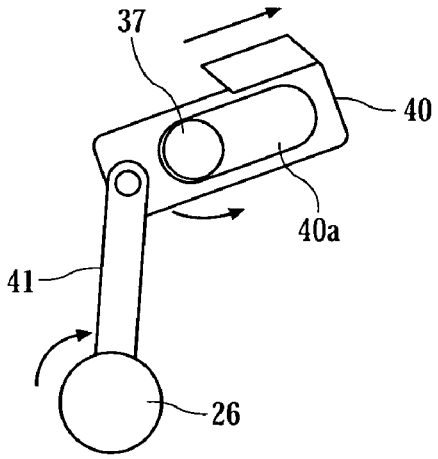
FIGS. 5A and 5B show an alternative design of the sheet support wings in accordance with another embodiment of the present invention.
Figure 5B:
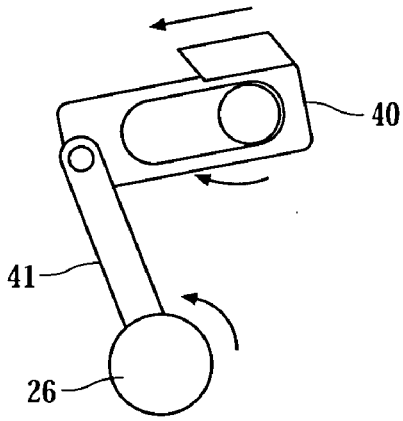

FIGS. 5A and 5B show an alternative design of the sheet support wings according to another embodiment. In this embodiment, each sheet support wing 40 is movable between an extended position (FIG. 5A) and a retracted position (FIG. 5B) by a sliding technique. Referring to FIG. 5A, each sheet support wing 40 has a slot 40*a*, through which the output roller shaft 37 is inserted. The slot 40*a* is configured so that each support wing 40 can slide between the extended position and the retracted position. Each support wing 40 is pivotally connected to one end of a linking structure 41. The other end of the linking structure 41 is fixedly mounted to the lifting shaft 26. Referring to FIG. 5B, when the lifting shaft 26 is driven to rotate counterclockwise, the linking structure 41 pivots counterclockwise, causing the support wing 40 to slide to the retracted position. From the retracted position, the sheet support wing 40 can be affected to slide back to the extended position by rotating the lifting shaft 26 clockwise.

Although the invention has been described with reference to the embodiments described above, it will be understood by those skilled in the art that various changes may be made, and equivalents may be substituted for various elements of the embodiments, without departing from the scope of the invention as set forth in the appended claims.

What is claimed is:

1. A system for media handling comprising:

a media picking unit for picking up individual media sheets from a stack of media sheets, the media picking unit comprising a pick roller, a pick arm, a rotatable pick roller shaft and a rotatable lifting shaft, one end of the pick arm being connected to the pick roller while the other end being pivotally connected to the pick roller shaft, said pick arm being pivotable between a picking position, whereby the pick roller is resting on top of the stack of media sheets, and an inactivated position, whereby the pick roller is lifted away from the stack; and a media output unit for advancing a printed media sheet toward an output area, the media output unit comprising at least one sheet support member operable to support a printed portion of the media sheet above the output area, said sheet support member being movable between a supporting position and a retracted position, wherein the sheet support member is linked to the lifting shaft by a linking structure, the linking structure and the media picking unit are configured such that the sheet support member is in the supporting position when the pick arm is in the picking position, and a rotational movement of the lifting shaft in one direction causes the sheet support member to move from the supporting position to the retracted position and at the same time causes the pick arm to pivot from the picking position to the inactivated position.

2. The system of claim 1, wherein the pick roller shaft is positioned substantially parallel to the lifting shaft and both shafts are coupled to each other by a coupling structure.

3. The system of claim 1, wherein the media picking unit further comprises:

a passive lifting gear rotatably mounted on the pick roller shaft at a location adjacent to the pick arm; and an active lifting gear fixedly mounted on the lifting shaft and in driving engagement with the passive lifting gear, wherein the pick arm is pivotable between the picking position and the inactivated position by a rotational movement of the passive lifting gear.

4. The system of claim 1, wherein the media output unit further comprises a plurality of output rollers mounted on an output roller shaft, and the sheet support member is movably coupled to the output roller shaft.

5. The system of claim 4, wherein at least two sheet support members are provided along the length of the output roller shaft.

6. The system of claim 4, the sheet support member is rotatably mounted on the output roller shaft.

7. The system of claim 6, wherein the lifting shaft has a crank member at one end, and the linking structure has one end that is pivotally linked to the crank member and another end that is pivotally linked to sheet support member, whereby a counterclockwise rotational movement of the crank causes to the sheet support member to rotate clockwise, and a clockwise rotational movement of the crank causes the sheet support member to rotate counterclockwise.

8. The system of claim 4, wherein the sheet support member is movably coupled to the output roller shaft so that the sheet support member can slide between the supporting position and the retracted position.

9. The system of claim 8, wherein one end of the linking structure is pivotally linked to the sheet support member while the other end is fixedly mounted to the lifting shaft.

10. The system of claim 3, wherein the passive lifting gear further comprises a radial member, and the pick arm further comprises a stopper adjacent to the passive lifting gear, the radial member being movable between a disengaging position, where the radial member is not in contact with the stopper and the pick arm is in the inactivated position, and an abutment position, where the radial member abuts against the stopper and the pick arm is in the inactivated position.

11. A printing apparatus comprising:

a media picking unit for picking up individual media sheets from a stack of media sheets, the media picking unit comprising a pivotable pick arm with a pick roller attached to one end thereof, and a rotatable lifting shaft; and a media output unit for advancing a printed media sheet toward an output area, the media output unit comprising at least two sheet support members operable to support a printed portion of the media sheet above the output area, wherein the sheet support members are linked to the lifting shaft by a linking structure, the linking structure and the media picking unit are configured so that the sheet support members are in a supporting position when the pick arm is in a picking position and a retraction of the sheet support member from the supporting position is synchronized with pivoting the pick arm from the picking position to an inactivated position.

12. The printing apparatus of claim 11, wherein the media picking unit further comprises:

a rotatable pick roller shaft arranged substantially parallel to the lifting shaft;

one end of the pick arm being connected to the pick roller while the other end being pivotally connected to the pick roller shaft.

13. The printing apparatus of claim 12, wherein the media picking unit further comprises:

a passive lifting gear rotatably mounted on the pick roller shaft at a location adjacent to the pick arm; and an active lifting gear fixedly mounted on the lifting shaft and in driving engagement with the passive lifting gear, wherein the pick arm is pivotable between the picking position and the inactivated position by a rotational movement of the passive lifting gear.

* * * * *